US007222460B2

(12) United States Patent
Francies, III et al.

(10) Patent No.: US 7,222,460 B2
(45) Date of Patent: May 29, 2007

(54) COVER FOR A CONCRETE CONSTRUCTION

(75) Inventors: Sidney E. Francies, III, Springboro, OH (US); Mark S. Hallam, Louisville, KY (US); Harry B. Lancelot, III, Centerville, OH (US)

(73) Assignee: Dayton Superior Corporation, Dayton, OH (US)

( * ) Notice: Subject to any disclaimer, the term of this patent is extended or adjusted under 35 U.S.C. 154(b) by 657 days.

(21) Appl. No.: 10/197,372

(22) Filed: Jul. 17, 2002

(65) Prior Publication Data

US 2004/0010985 A1 Jan. 22, 2004

(51) Int. Cl.
*E04B 1/34* (2006.01)

(52) U.S. Cl. ..... 52/3; 52/125.5; 52/301; 52/465; 52/698

(58) Field of Classification Search ..... 52/3, 52/125.4, 125.5, 301, 677, 689, 682, 465, 52/300, 698, DIG. 12, 459, 467; 403/282, 403/278, 279; 220/780, 496; 411/372.5, 411/372.6, 373, 508
See application file for complete search history.

(56) References Cited

U.S. PATENT DOCUMENTS

| | | | | | |
|---|---|---|---|---|---|
| 1,024,761 | A | * | 4/1912 | Anderson | 52/301 |
| 1,071,523 | A | | 8/1913 | Lally | |
| 1,324,076 | A | * | 12/1919 | Smith | 52/301 |
| 1,970,860 | A | | 8/1934 | Lowell | |
| 3,200,551 | A | | 8/1965 | Jakeway | |
| 3,303,626 | A | * | 2/1967 | Brigham | 52/717.05 |
| 3,531,068 | A | | 9/1970 | Fischer | |
| 3,694,989 | A | * | 10/1972 | Oliver et al. | 52/678 |
| 3,849,106 | A | * | 11/1974 | Kornis et al. | 504/280 |
| 4,063,397 | A | * | 12/1977 | Follows | 52/684 |
| 4,067,155 | A | * | 1/1978 | Ruff et al. | 52/105 |
| 4,137,680 | A | * | 2/1979 | Doonan | 52/302.7 |
| 4,270,328 | A | | 6/1981 | Page et al. | |
| 4,301,629 | A | | 11/1981 | Farr | |
| 4,386,486 | A | | 6/1983 | Holt et al. | |
| 4,437,642 | A | * | 3/1984 | Holt | 249/175 |
| 4,443,980 | A | | 4/1984 | Pennypacker | |
| 4,580,378 | A | * | 4/1986 | Kelly et al. | 52/125.5 |
| 4,598,523 | A | * | 7/1986 | Tolliver | 52/685 |
| 4,671,554 | A | | 6/1987 | Lancelot | |
| 4,807,843 | A | | 2/1989 | Courtois et al. | |
| 4,821,994 | A | | 4/1989 | Fricker | |
| 4,850,778 | A | * | 7/1989 | Clough et al. | 411/433 |
| 4,932,818 | A | * | 6/1990 | Garwood | 411/107 |
| 5,060,436 | A | * | 10/1991 | Delgado, Jr. | 52/295 |
| 5,155,954 | A | | 10/1992 | Roire | |
| 5,226,265 | A | | 7/1993 | Kelly et al. | |

(Continued)

FOREIGN PATENT DOCUMENTS

| | | |
|---|---|---|
| WO | WO 98/12401 | 3/1998 |

*Primary Examiner*—Carl D Friedman
*Assistant Examiner*—Chi Q. Nguyen
(74) *Attorney, Agent, or Firm*—Thompson Hine LLP

(57) ABSTRACT

A cover for a concrete construction has a pair of anchor-engaging members extending from a disk-shaped body. The anchor-engaging members include fins which are configured to engage an anchor formed into a recess of a concrete block or wall to cover the recess. The cover is easily installed to the anchor by positioning the cover over the recess and urging the anchor-engaging member into engagement with the anchor.

9 Claims, 2 Drawing Sheets

U.S. PATENT DOCUMENTS

| | | | | |
|---|---|---|---|---|
| 5,528,867 | A | 6/1996 | Thompson | |
| 5,809,703 | A | 9/1998 | Kelly | |
| 6,085,478 | A | 7/2000 | Workman | |
| 6,226,952 | B1 * | 5/2001 | Romeu Guardia | 52/698 |
| 6,341,452 | B1 | 1/2002 | Bollinghaus | |
| 6,347,916 | B1 * | 2/2002 | Ramirez | 411/372.5 |
| 6,557,317 | B2 * | 5/2003 | Sorkin | 52/684 |
| 2001/0004824 | A1 | 6/2001 | Hazama | 52/701 |
| 2002/0043036 | A1 * | 4/2002 | Nesbitt | 52/301 |

* cited by examiner

COVER FOR A CONCRETE CONSTRUCTION

FIELD OF THE INVENTION

The present invention pertains to concrete building materials, and more particularly to a cover which may be used to close off a recess formed in a concrete section, such as a wall panel or other concrete structure.

BACKGROUND OF THE INVENTION

Concrete is often used as a building material in the construction of commercial buildings and other structures. Typically, concrete will be formed into blocks or panels which may thereafter be assembled at a job site into a desired structure. The blocks and panels may be formed at a manufacturing plant for transportation to the job site, or they may be formed directly at the job site. For example, concrete panels which are used to construct concrete walls are generally formed by pouring concrete into forms which have been arranged on a horizontal surface, such as the floor of a building under construction. Once a concrete panel has sufficiently cured, the panel may be raised into position to form a wall section.

To facilitate raising the panels, anchors are typically embedded in the concrete before the concrete cures. The anchors are recessed into a surface of the panel so that the anchor does not protrude above the top surface of the panel after it has been raised into position. U.S. Pat. No. 4,807,843 to Courtois et al., assigned to the assignee of the present invention, discloses a plug which may be used to form the recess around an anchor during creation of the concrete panel. The anchor may be in the shape of a hook, a rod having an enlarged end, or an eye whereby the anchor may be coupled to a crane for raising and maneuvering the panel into position once the concrete has cured.

After the panel has been placed in position, it is generally desired to patch the recess and cover the anchor for aesthetics or to avoid the accumulation of water or other liquids in the recess, which may rust the anchor and cause surface staining of the concrete surrounding the anchor.

In the past, these recesses have been patched by filling the recess with concrete, or other material, and scraping off the excess patch material to create a level surface. U.S. Pat. No. 4,386,486 to Holt et al. discloses a cover which may be used to patch a recess in a concrete panel. However, the cover of Holt et al. contains multiple pieces which may become separated at the job site, resulting in an unusable cover. The cover of Holt et al. has a plug which must be installed through an opening in the anchor prior to attaching the cover over the recess. Because it may be difficult to maneuver the plug into the hole in the anchor and then attach the cover to the plug, this type of cover and the prior method of patching a recess with concrete or other material are time consuming for workers at the job site.

U.S. Pat. No. 5,528,867 to Thompson discloses a cover having a cone shaped lower portion with a hole that engages the enlarged head of an anchor. While this type of cover may be snapped into place without excessive manipulation, it is designed to engage the anchor at a specific depth below the surface of the concrete panel. Therefore, the depth of the anchor beneath the surface needs to be carefully controlled or a range of various cover sizes must be provided.

There is thus a need for a cover which can be used to patch a recess formed in a concrete section around an anchor and which overcomes drawbacks of the prior art, such as those described above.

SUMMARY OF THE INVENTION

The present invention provides a cover which may be used with a concrete construction, such as a concrete block or concrete panel, to cover the recess in the concrete section which has been formed around an anchor embedded into the concrete. In an exemplary embodiment, the cover of the present invention has a disk-shaped body portion sized to cover completely a recess which has been formed into a concrete panel. Two anchor-engaging members extend from a lower portion of the body member and are spaced apart a distance so that the anchor of the concrete section may be received between the anchor-engaging members. Opposing portions of the anchor-engaging members have several fins disposed along the lengths of the members and shaped to engage the anchor of the concrete section therebetween. The fins are arranged on the anchor-engaging members such that adjacent fins are spaced apart in a parallel fashion.

In another exemplary embodiment, the height of the fins on each anchor-engaging member, as measured from the sides of the anchor-engaging members, decreases with the distance that the fins are located from the distal end of the anchor-engaging members. The fins are formed from a material which permits them to deform and thereby frictionally hold the cover in place when the anchor-engaging members are urged into contact with the anchor so that the anchor is received between the anchor-engaging members. Advantageously, the cover of the present invention may be easily and securely fixed to the anchor of a concrete section completely to cover the recess surrounding the anchor. The cover thus prevents the accumulation of fluids and other unwanted debris within the recess.

In another exemplary embodiment, the cover is provided with angled tabs at the distal ends of the anchor-engaging members. The tabs are configured to facilitate installation of the anchor-engaging members over the anchor of the concrete section.

In another exemplary embodiment, a concrete construction includes a concrete section such as a block or panel, which has at least one anchor formed into a recess of the concrete section. The concrete construction further includes a cover coupled to the anchor and positioned over the recess to cover the recess. In another exemplary embodiment, a method of covering an anchor which has been formed into a recess of a concrete section includes providing a cover having first and second anchor-engaging members and a plurality of fins disposed on opposing sides of the anchor-engaging members, and positioning the cover over the recess of the concrete section to engage the anchor-engaging members with the anchor of the concrete section.

The features and objectives of the present invention will become more readily apparent from the following detailed description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
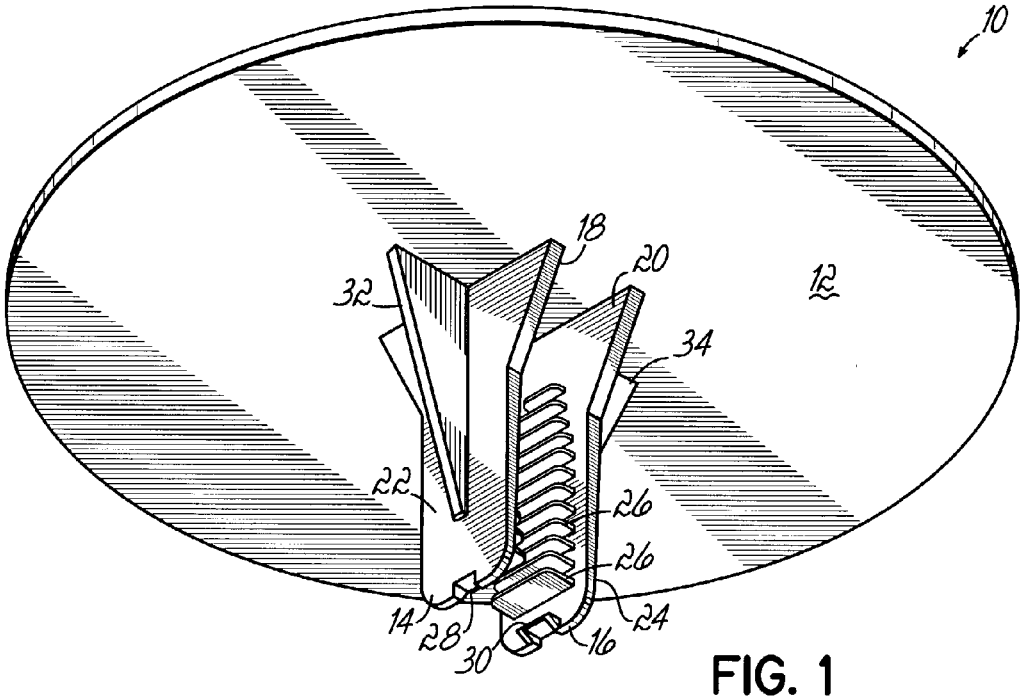
FIG. 1 is a perspective view of an exemplary cover of the present invention.
Figure 2:
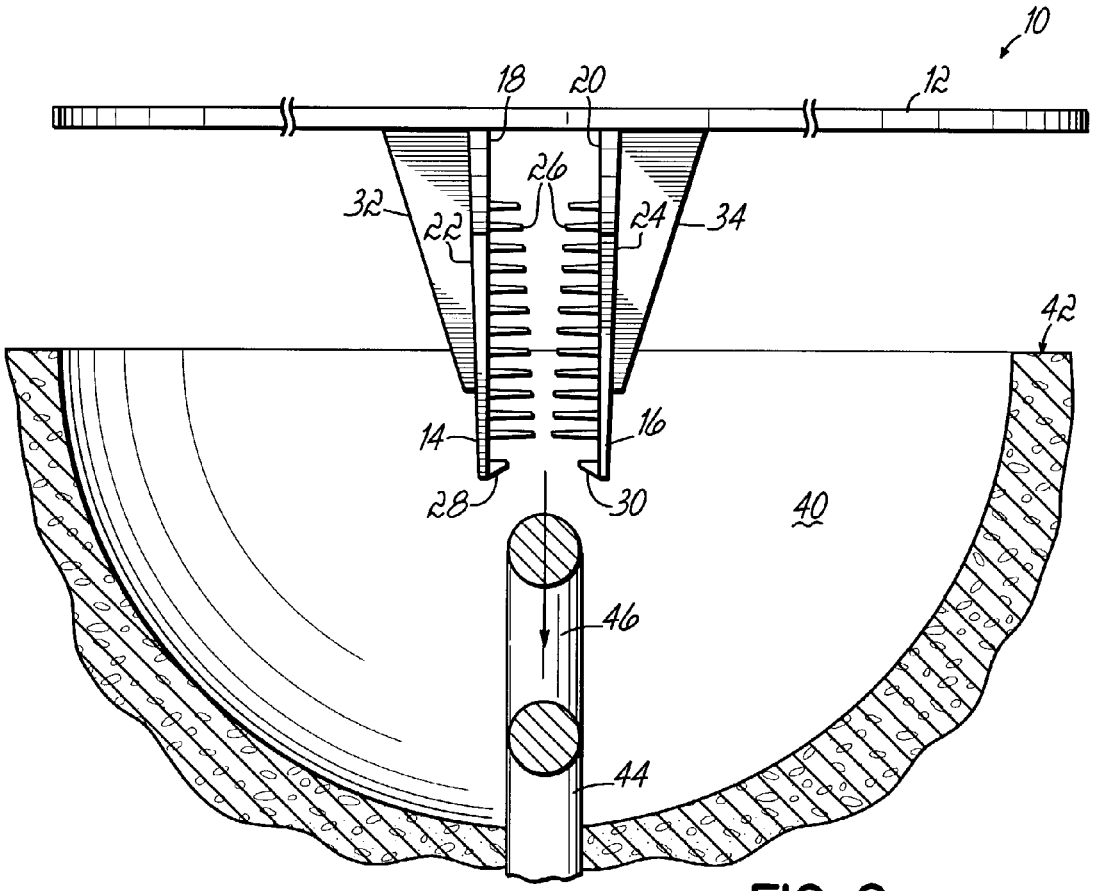
FIG. 2 is a partial cross-section depicting the exemplary cover of FIG. 1 prior to installation on a concrete section.
Figure 3:
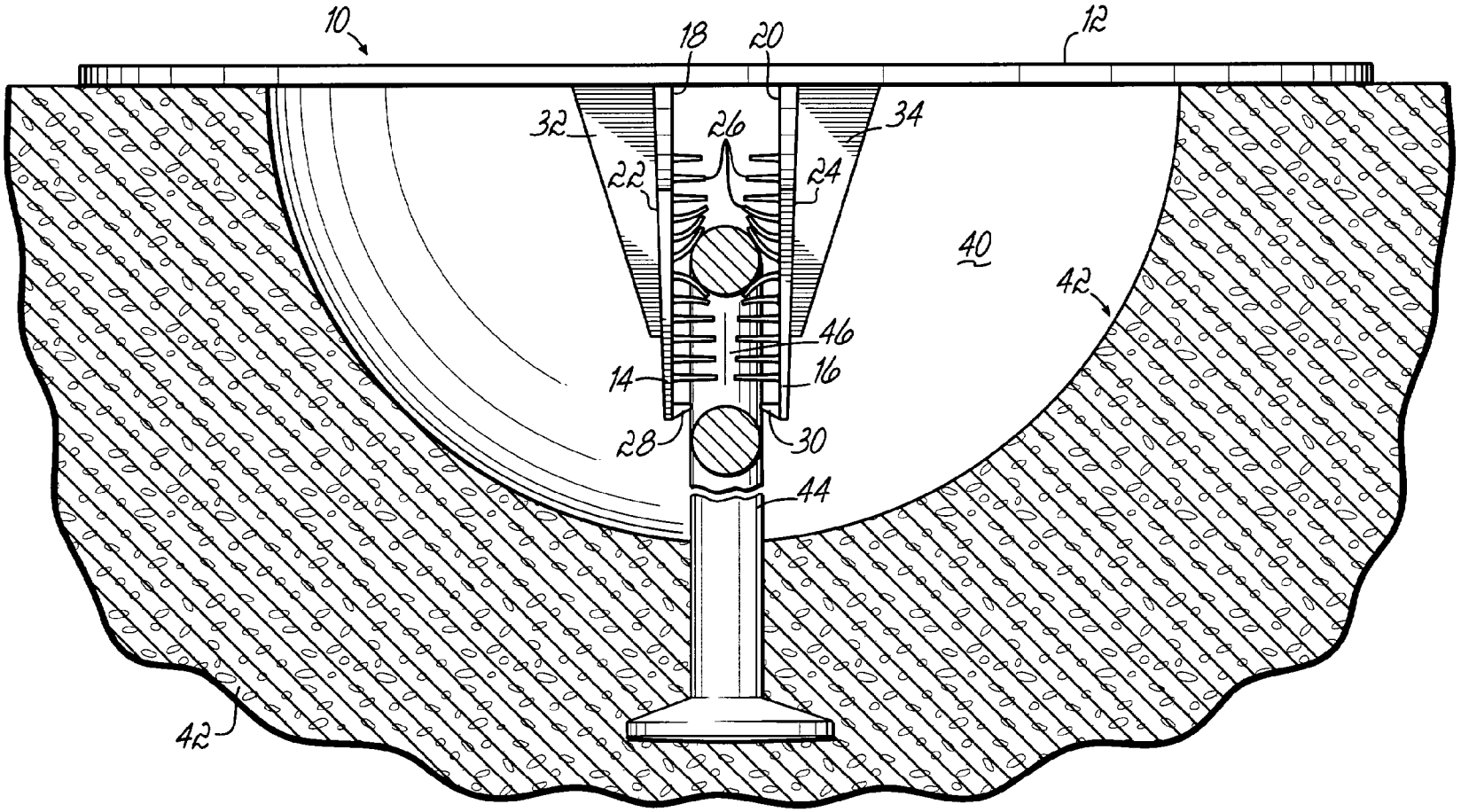
FIG. 3 is a view similar to FIG. 2, depicting the exemplary cover of FIG. 1 engaging an anchor of a concrete construction.

Referring to FIGS. 1–3, there is shown an exemplary cover 10 for a concrete construction. The cover 10 includes a generally disk-shaped body member 12 which is sized to completely cover a recess 40 which has been formed into a concrete construction 42 to surround an anchor 44 embedded into the concrete 42. First and second anchor-engaging members 14,16 are located near the central portion of the body member 12 and extend away from the body member 12. The anchor-engaging members 14, 16 are spaced apart a distance to permit the anchor 44 of the concrete construction 42 to be received between opposing first sides 18, 20 of the first and second anchor-engaging members 14, 16.

A plurality of fins 26 are arranged on the first sides 18, 20 of the first and second anchor-engaging members 14, 16. The fins 26 are arranged on each anchor-engaging member 14, 16 in a generally parallel arrangement and extend from the first sides 18, 20 of the anchor-engaging members 14, 16 toward the opposite anchor-engaging member. The height of the fins 26, measured from the first sides 18, 20 of the anchor-engaging members 14, 16 is sized such that the fins 26 positively engage the anchor 44 of the concrete section 42 as the cover 10 is placed over the recess 40 to engage the anchor 44. In the exemplary embodiment shown, the fins 26 on each anchor-engaging member 14, 16 decrease in height from the distal ends of the anchor-engaging member 14, 16 toward the body member 12 of the cover 10.

Advantageously, the fins 26 are formed from a material which permits the fins 26 to deform as the anchor-engaging members 14, 16 are urged into contact with the anchor 44, to thereby engage frictionally the anchor 44. To facilitate installation of the cover 10 such that the anchor 44 is received between the anchor-engaging members 14, 16, angled tabs 28, 30 may be provided on the ends of the anchor-engaging members 14, 16. The anchor-engaging members 14, 16 may also be provided with reinforcing gussets 32, 34 extending between second, oppositely facing sides 22, 24 of the anchor-engaging members 14, 16 and the body member 12.

Referring to FIGS. 2 and 3, installation of the exemplary cover 10 to engage an anchor 44 in a concrete section 42 and to cover the recess 40 formed around the anchor 44 will be described. As depicted in FIG. 2, the cover 10 may be positioned over the recess 40 such that the first and second anchor-engaging members 14, 16 are aligned to engage the anchor 44 which has been embedded in the concrete section 42. Advantageously, the cover 10 may simply be fitted over the anchor 44, whereby the angled tabs 28, 30 at the ends of the anchor-engaging members 14, 16 facilitate alignment and introduction of the anchor 44 between the anchor-engaging members 14, 16.

Referring to FIG. 3, as the cover 10 is forced over the anchor 44, the fins 26 on the anchor-engaging members 14, 16 are deformed by the anchor 44 to frictionally engage the anchor 44 and thereby retain the cover 10 in position over the recess 40. The anchor 44 may include an aperture 46 or hook section that is further engaged by the fins 26 of the anchor-engaging members 14, 16 to help retain the cover 10 over the recess 40. As described above, the cover 10 of the present invention may quickly and easily be installed over a recess 40 formed in a concrete section 42 to engage the anchor 44 embedded in the recess 40 without undue manipulation of the cover 10 and without the need for multiple parts of the cover 10 which may become separated prior to installation.

In another exemplary embodiment, a method of forming a concrete wall section includes the steps of filling a mold with uncured concrete to create the wall section, forming at least one recess 40 in the concrete wall section, embedding an anchor 44 within the recess 40, raising the concrete wall section to a desired position using the anchor 44, and placing a cover 10 that has anchor-engaging members 14, 16 and a plurality of fins 26 on the sides 18, 20 of the anchor-engaging members 14, 16 over the recess 40 to engage the anchor 44.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A cover for a concrete construction having an anchor disposed in a recess, the cover comprising:

a substantially planar body member configured to cover completely the recess in the concrete construction;

first and second anchor engaging members extending substantially perpendicularly from said body member and laterally spaced apart in opposing relation, said anchor engaging members having first sides facing one another, second sides facing away from one another, and distal ends opposite said body member; and a plurality of laterally elongated fins disposed on said first sides of said anchor engaging members to positively engage the anchor therebetween, said plurality of fins arranged in parallel spaced relation along said first sides and configured to elastically and substantially deflect both toward and away from said distal ends of said anchor engaging members.

2. The cover of claim 1, wherein the height of said plurality of fins, from said first sides, decreases with distance from said distal ends of said anchor engaging members.

3. The cover of claim 1, wherein said plurality of fins are configured to deform when said anchor engaging members are urged into contact with the anchor to thereby engage frictionally the anchor.

4. The cover of claim 1, further comprising:

angled tabs disposed on said distal ends of said first and second anchor engaging members to facilitate coupling of said anchor engaging members with the anchor.

5. The cover of claim 1, further comprising:

first and second gussets extending between said body member and said second sides of said first and second anchor engaging members, respectively, to reinforce said anchor engaging members, wherein said gussets abut said anchor engaging members along at least a portion of the fin-disposed length of said anchor engaging members.

6. A concrete construction, comprising:

a concrete section, including at least one anchor formed into a recess of said concrete section; and a cover coupled to said anchor and disposed proximate the recess of said concrete section, said cover comprising:

a body member, first and second anchor engaging members extending from said body member and spaced apart in opposing relation, said anchor engaging members having first sides facing one another and second sides facing away from one another, and a plurality of fins disposed on said first sides of said anchor engaging members, said plurality of fins arranged in parallel spaced relation along said first sides.

7. A method of covering an anchor formed into a recess of a concrete section, comprising:

providing a cover having first and second anchor engaging members and a plurality of fins disposed on opposing sides of the anchor engaging members; and positioning the cover proximate the recess to engage frictionally the anchor engaging members and the anchor.

8. A cover for a concrete construction having an anchor disposed in a recess, the cover comprising:

a substantially planar body member configured to cover completely the recess in the concrete construction;

first and second anchor engaging members extending substantially perpendicularly from said body member and laterally spaced apart in opposing relation, said anchor engaging members having first sides facing one another, second sides facing away from one another, and distal ends opposite said body member;

a plurality of fins disposed on said first sides of said anchor engaging members, said plurality of fins arranged in parallel spaced relation along said first sides and configured to directly engage the anchor; and first and second gussets extending between said body member and said second sides of said first and second anchor engaging members, respectively, to reinforce said anchor engaging members, wherein said gussets abut said anchor engaging members along at least a portion of the fin-disposed length of said anchor engaging members.

9. The cover of claim 8, wherein said fins are laterally elongated, and configured to elastically and substantially deflect both toward and away from said distal ends of said anchor engaging members.

* * * * *